United States Patent [19]

Shamblin

[11] Patent Number: 4,840,311

[45] Date of Patent: Jun. 20, 1989

[54] SHOWER DISPENSING HEAD

[76] Inventor: Judy A. Shamblin, 4222 Mohawk, Baytown, Tex. 77521

[21] Appl. No.: 215,267

[22] Filed: Jul. 5, 1988

[51] Int. Cl.[4] ..... B05B 7/30; B05B 11/02

[52] U.S. Cl. ..... 239/74; 239/305; 239/307; 239/322

[58] Field of Search ..... 239/74, 303, 304, 305, 239/307, 310, 312, 320, 321, 322; 222/41, 47, 49, 156, 157, 389, 630

[56] References Cited

U.S. PATENT DOCUMENTS

| | | | |
|---|---|---|---|
| 2,477,998 | 8/1949 | McCowan | 239/310 |
| 2,609,232 | 9/1952 | Taulman | 239/305 |
| 2,743,913 | 5/1956 | Gundlach | 239/311 |
| 3,003,703 | 10/1961 | Lambto | 239/309 |
| 3,091,402 | 5/1963 | Palmer | 239/305 |
| 3,367,580 | 2/1968 | Hronas | 239/312 |
| 3,446,438 | 5/1969 | Watson | 239/312 |
| 3,486,695 | 12/1969 | Novak | 239/305 |
| 3,655,135 | 4/1972 | Altman | 239/310 |
| 3,713,585 | 1/1973 | Conklin | 239/305 |
| 3,880,323 | 4/1975 | Viehe | 222/47 |
| 4,047,541 | 9/1977 | Mercier et al. | 239/322 |
| 4,218,013 | 8/1980 | Davison | 239/305 |

*Primary Examiner*—Andres Kashnikow
*Assistant Examiner*—Karen B. Merritt
*Attorney, Agent, or Firm*—Leon Gilden

[57] ABSTRACT

A shower dispensing head is set forth wherein the first of a pair of aligned containers is formed with a mechanical two-way valve. A flow of water is directed past an orifice positioned within the water flow conduit of the shower head to selectively enable a bath oil to be emulsified and mixed with the outlet water wherein a second underlying container is provided with a two-way valve to enable pressurization of a container associated therewith to enable dispensing of soap therefrom. An associated indicator of the second container provides at-a-glance indication of the content level of the second container.

8 Claims, 1 Drawing Sheet

SHOWER DISPENSING HEAD

BACKGROUND OF THE INVENTION

1. Field of the Invention

The field of invention relates to shower heads and more particularly pertains to a new and improved shower head that enables selective mixing of bath oil with the shower water and provides a pressurized supply of liquid soap for dispensing, as deemed necessary by a user.

2. Description of the Prior Art

The use of shower head attachments in association with shower heads is well known in the prior art to provide dispensing of various toiletries and the like. These dispensers have normally been of a relatively elaborate and expansive structure to limit their incorporation by users. For example, U.S. Pat. No. 3,091,402 to Palmer sets forth a shower head dispenser wherein individual containers are secured to main rotatable turret body for association of the various dispensers selectively with the shower outlet.

U.S. Pat. No. 3,367,580 to Hronas sets forth an enlarged shower head for containment of a shower additive for use in association with the outlet of the shower, but is of a relatively cumbersome structure as related to the instant invention that does not tamper with the desired configuration of the shower head outlet.

U.S. Pat. No. 3,655,135 to Altman sets forth a steam outlet head wherein an interior channel is associated with a reservoir for dispensing of a fragrance through the head by means of steam flow through the head.

U.S. Pat. No. 3,003,703 to Lambton sets forth a shower head with a capsule adjacent a suction passage to enable mixing of the capsule's contents with the shower.

U.S. Pat. No. 2,743,913 to Gundlach sets forth a detergent dispensing fixture for use in association with a shower head from an upper to a lowermost position to enable mixing of the contents of the liquid detergent with the shower water to be dispensed. The prior art sets forth the elaborate and cumbersome organization that the instant invention attempts to overcome.

As such, it may be appreciated that there is a continuing need for a new and improved shower dispensing head that overcomes the problem of storage and effectiveness, and in this respective, the present invention substantially fulfills this need.

SUMMARY OF THE INVENTION

In view of the foregoing disadvantages inherent in the known types of shower dispensing heads now present in the prior art, the present invention provides a shower dispensing head wherein the same compactly and efficiently stores bathing liquids for subsequent use and may be further easily and efficiently actuated to enable withdrawal of such contents. As such, the general purpose of the present invention, which will be described subsequently in greater detail, is to provide a new and improved shower dispensing head which has all the advantages of the prior art shower dispensing heads and none of the disadvantages.

To attain this, the present invention comprises a shower dispensing head wherein the same provides an aligned overlying and underlying storage container wherein the overlying container is formed with a two-way valve to enable flow of a bathing oil directed to an orifice to emulsify and combine with the stream of shower outlet water wherein the underlying container is formed with an indicator to visually indicate contents of the container while providing valving structure pressurized by the water pressure within the associated plumbing to enable easy and efficient withdrawal of a bathing soap from the underlying dispenser.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shower dispensing head which has all the advantages of the prior art shower dispensing heads and none of the disadvantages.

It is another object of the present invention to provide a new and improved shower dispensing head which may be easily and efficiently manufactured and marketed.

It is a further object of the present invention to provide a new and improved shower dispensing head which is of a durable and reliable construction.

An even further object of the present invention is to provide a new and improved shower dispensing head which is susceptible of a low cost of manufacture with regard to both materials and labor, and which accordingly is then susceptible of low prices of sale to the consuming public, thereby making such shower dispensing heads economically available to the buying public.

Still yet another object of the present invention is to provide a new and improved shower dispensing head which provides in the apparatuses and methods of the prior art some of the advantages thereof, while simultaneously overcoming some of the disadvantages normally associated therewith.

Still another object of the present invention is to provide a new and improved shower dispensing head that provides an aligned plurality of dispensing containers wherein an overlying container is formed with a two-way valve to enable dispensing of a bathing oil directly into the shower outlet wherein an underlying container is formed with a two-way valve to enable pressurizing of the container to enable selective withdrawal of a liquid soap therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
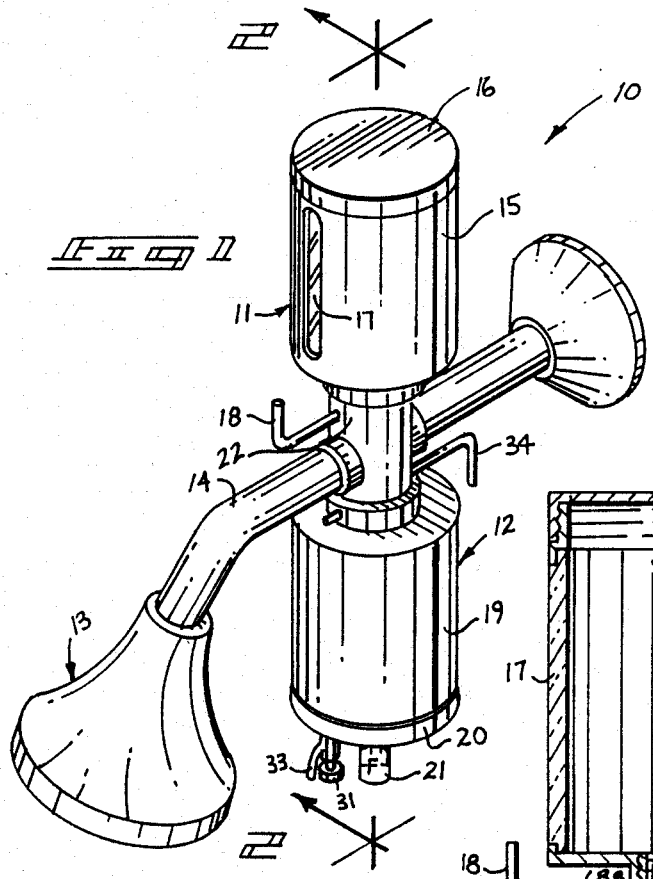
FIG. 1 is an isometric illustration of the instant invention.
Figure 2:
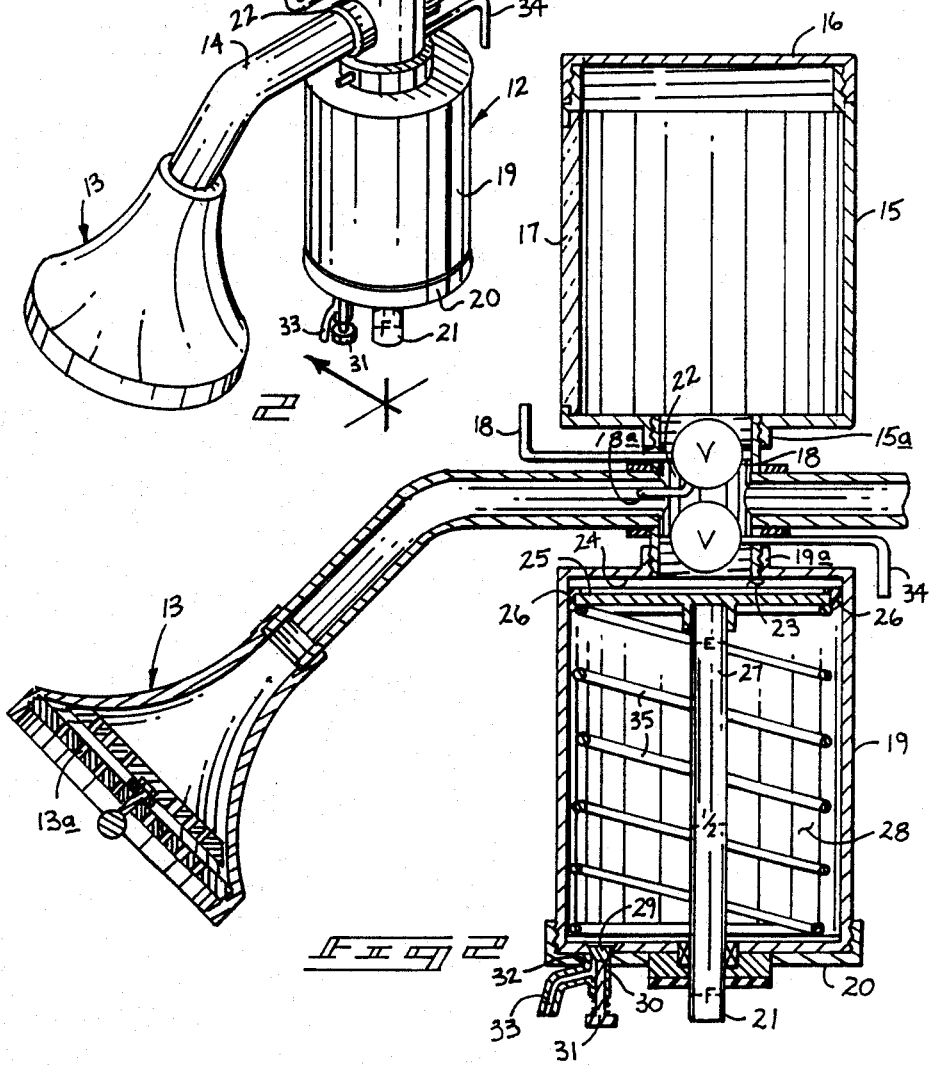
FIG. 2 is an orthographic illustration of the instant invention taken along the lines 2—2 of FIG. 2.

With reference now to the drawings, and in particular to FIGS. 1 and 2 thereof, a new and improved shower dispensing head embodying the principles and concepts of the present invention and generally designated by the reference numeral 10 will be described.

More specifically, it will be noted that the shower dispensing head apparatus 10 essentially comprises an oil dispensing container 11 axially aligned with and overlying a liquid soap dispensing container 12, each threadedly secured at opposite ends to a central union member 22 that is threadedly secured in alignment with an existing water directing conduit 14 that directs the water from the conduit to a conventional shower head 13 formed with a conventional perforated plate 13*a*.

The oil dispensing container 11 includes an elongate first container 15 of a convenient cylindrical configuration, but may in fact be of any configuration to adequately house a desired quantity of liquid, which in this case comprises a bath oil. A threadedly removable lid 16 threadedly securable to an upper end of the first container 15 enables periodic refilling of the container 11 and is formed with a transparent side gauge 17 for indication of fluid level within the container 11. A first two-way manually manipulatable valve 18 enables selective directing of a bath oil within the container 11 to an outlet pipe 18*a* formed with its terminal end axially parallel to the conduit 14 whereupon opening of valve 18, bath oil contained within the elongate first container 15 is directed through the valve and is drawn from the outlet pipe 18*a* by the passage of water under pressure within the conduit 14. It is required that the outlet pipe 18*a* be parallel to the axis of the conduit 14 to minimize water intrusion within the elongate first container 15 in withdrawing of the bath oil.

The underlying axially aligned second container 19 is threadedly secured to the other end of the union member 22 opposed to that of the first elongate container 15 for purposes of compact and convenient orientation of the dispenser head 10 relative to a shower head 13.

The second container 19 is formed with an upper axial aligned threaded end 19*a* aligned with the threaded end 15*a* of the first elongate container and wherein the second valve 34 is positioned within the union member 22 to enable convenient removal of the second container 19. The second container 19 is formed with a threadedly removable lid 20 to enable refilling of the central reservoir 28 within the second container 19.

When secured, as illustrated in FIGS. 1 and 2, an expanding chamber 23 is formed between an upper wall 24 of the second container 19 and a reciprocating piston 25 that is formed with a circumferential seal 26 thereabout to sealingly engage the interior surface of the second container 19.

When secured to the union member 22, as illustrated, fluid pressure present within the conduit 14 directs pressure against the upper face of the piston 25 through the manually manipulatable two-way valve 34 and will accordingly depress the piston 25 against the included liquid soap to be contained therein. When the container is full of soap, as illustrated for example in FIG. 2, the piston will be at its upper extent of travel whereupon depletion of the liquid soap within the reservoir 28 will allow the piston 25 to be driven downwardly whereupon the reciprocating gauge 27 will visually indicate externally of the second container 19 the relative quantity of liquid soap remaining within the container. A spring 35 provides a compressive force onto an interior surface of the piston 25 of force less than that supplied by typical water pressure within the conduit 14 and accordingly in the absence of water pressure tends to restore the piston 25 to its upper extent of travel, as illustrated in FIG. 2. This conveniently allows ease of filling of the container that upon threadedly removing the container 19 from the lower end of the threaded union 22, the threaded lid 20 is removed and liquid soap deposited therein whereafter the lid 20 is re-secured to container 19 and the container 19 is then threadedly re-secured to the union 22.

To withdraw liquid soap from the second container 19, a tapered valve stem 29 is formed within a compartment on the lid 20 that cooperates with a tapered seat 30 whereupon manually forcing stem 29 upwardly by the valve plunger 31, the valve stem 29 is raised and liquid soap is released. Compressing piston 25, depressed by water pressure as noted above, forces liquid soap through the associated fluid conduit 32 in fluid communication with the interior reservoir 28 and directs the liquid soap through the spigot 33 for access by a user.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A shower dispensing head apparatus for selectively supplying bath toiletry fluid through a shower head in full communication with said dispensing head, said dispensing head apparatus comprising, an upper elongate container removable secured to an upper end of a union, and a lower elongate container underlying said upper container and removably secured to a lower end of said union, and said union secured to and in fluid communication with a water conduit directing water to said shower head, and said upper container including a lid removably secured to said upper container for replenishment of a toiletry fluid in said upper container, and a first valve positioned in fluid communication between said upper container and an outlet pipe wherein said outlet is positioned within said water conduit for supplying a predetermined quantity of said toiletry fluid within said water conduit, and said lower elongate container including a lid removably secured to said lower elongate container remote from said union;

said lid including an outlet spigot in fluid communication with a manually manipulatable third valve and plunger extending outwardly of said lid for directing a toiletry fluid within said lower container through said spigot, and a second valve positioned between said water conduit and a piston within said lower container to pressurize said toiletry fluid within said lower container.

2. A shower dispensing head apparatus as set forth in claim 1 wherein said upper elongate container includes an elongate axis in alignment with an axis defining said lower elongate container.

3. A shower dispensing head apparatus as set forth in claim 2 wherein said outlet pipe defines an axis parallel to an axis defining said water conduit.

4. A shower dispensing head apparatus as set forth in claim 3 wherein a spring is captured between said piston and said lid of said lower container to provide a force to said piston less than that of a pressurized water within said water conduit for normally extending said piston within said lower container.

5. A shower dispensing head apparatus as set forth in claim 4 wherein a reciprocating gauge is orthogonally and integrally secured to an interior surface of said piston, wherein said reciprocating gauge extends outwardly of said container and through said lid for indicating a quantity of toiletry fluid contained within said lower container when said second valve is in an open orientation to enable water pressure directed through said water conduit to impose upon said piston.

6. A shower dispensing head apparatus as set forth in claim 5 wherein said plunger includes a tapered valve stem securable onto a complementary tapered valve seat to enable toiletry fluids to be directed through said spigot when said valve stem is removed from said valve seat.

7. A shower dispensing head apparatus as set forth in claim 6 wherein said valve stem is integrally secured to said plunger.

8. A shower dispensing head apparatus as set forth in claim 7 wherein said piston includes a circumferential seal between said piston and an interior surface of said lower container.

* * * * *